US011278934B2

(12) United States Patent
Schneider

(10) Patent No.: US 11,278,934 B2
(45) Date of Patent: Mar. 22, 2022

(54) DEDUSTING APPARATUS HAVING AIR KNIVES AND IONIZING WIRES

(71) Applicant: Heinz Schneider, Lancaster, PA (US)

(72) Inventor: Heinz Schneider, Lancaster, PA (US)

( * ) Notice: Subject to any disclaimer, the term of this patent is extended or adjusted under 35 U.S.C. 154(b) by 0 days.

(21) Appl. No.: 17/022,789

(22) Filed: Sep. 16, 2020

(65) Prior Publication Data

US 2021/0187552 A1 Jun. 24, 2021

Related U.S. Application Data

(60) Provisional application No. 62/949,524, filed on Dec. 18, 2019.

(51) Int. Cl.

| | |
|---|---|
| ***B07B 4/04*** | (2006.01) |
| ***B08B 6/00*** | (2006.01) |
| ***B07B 11/08*** | (2006.01) |
| ***B07B 11/06*** | (2006.01) |
| ***B07B 11/02*** | (2006.01) |

(52) U.S. Cl.

CPC ..... *B07B 4/04* (2013.01); *B07B 11/02* (2013.01); *B07B 11/06* (2013.01); *B07B 11/08* (2013.01); *B08B 6/00* (2013.01)

(58) Field of Classification Search

CPC ..... B07B 11/08; B07B 11/06; B07B 11/02; B07B 4/04; B07B 4/08; B07B 1/4609; B07B 2201/04; B08B 6/00; B08B 5/023

USPC ..... 209/534

See application file for complete search history.

(56) References Cited

U.S. PATENT DOCUMENTS

| | | | | |
|---|---|---|---|---|
| 719,942 | A * | 2/1903 | Hermann | B07B 13/00 209/44.4 |
| 744,516 | A * | 11/1903 | Early | B07B 1/4609 209/393 |
| 1,193,273 | A * | 8/1916 | Lee | B07B 1/12 209/354 |
| 7,621,975 | B2 | 11/2009 | Schneider | |
| 8,833,563 | B1 | 9/2014 | Schneider | |
| 8,931,641 | B2 | 1/2015 | Schneider | |
| 2020/0290087 | A1* | 9/2020 | Sosnowski | B07B 4/08 |

FOREIGN PATENT DOCUMENTS

| | | | |
|---|---|---|---|
| CN | 110302960 | A * | 10/2019 |
| CN | 111054628 | A * | 4/2020 |
| CN | 112354623 | A * | 2/2021 |

* cited by examiner

*Primary Examiner* — Patrick H Mackey

(57) ABSTRACT

A dedusting apparatus removes dust and debris from particulate material flowing over the surface of a wash deck formed with steps and incorporating an air knife engaging the flow of particulate material as the material drops from one wash deck level to another. An ionizing wire is placed at each step on the wash deck so that the air knife blows negative ions from the ionizing wire into the particulate material falling off the step onto the level of wash deck below the ionizing wire. The wash deck is formed with openings to allow air to blow through the wash deck surface and remove dust and debris from the flow of particulate material. The wash deck can be constructed from modules supported on one another in a manner to present an overhang at each step. The wash deck can be formed from a flat pattern as a unitary bent structure.

18 Claims, 7 Drawing Sheets

Fig. 6
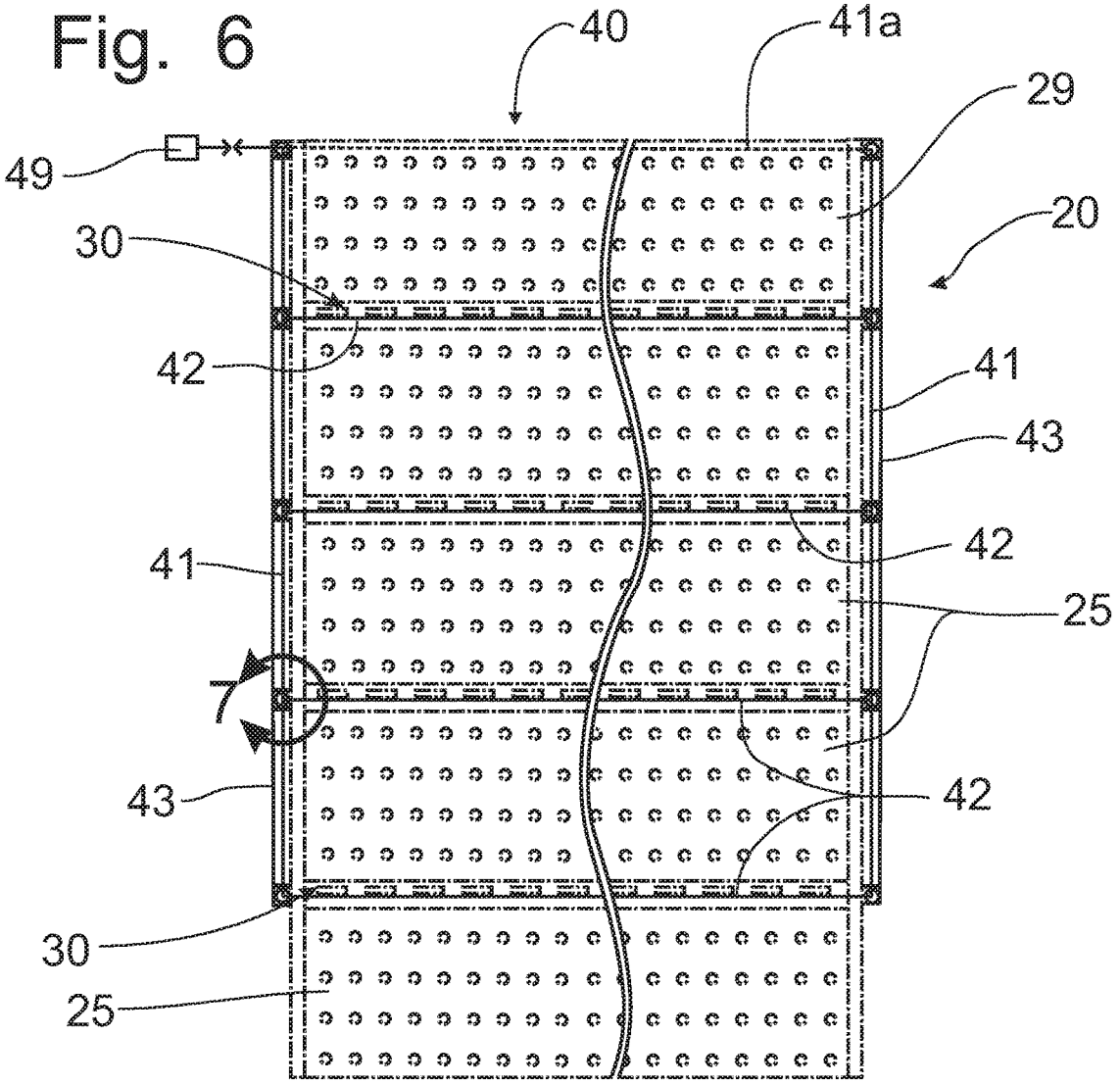
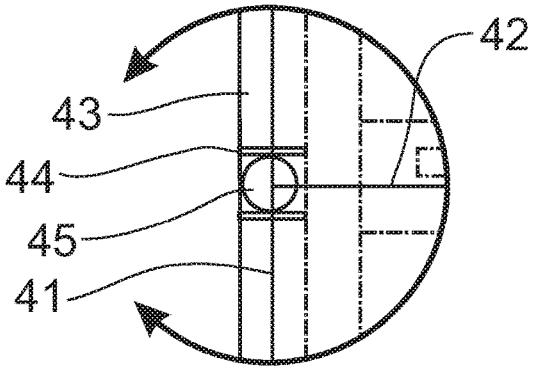
Fig. 7
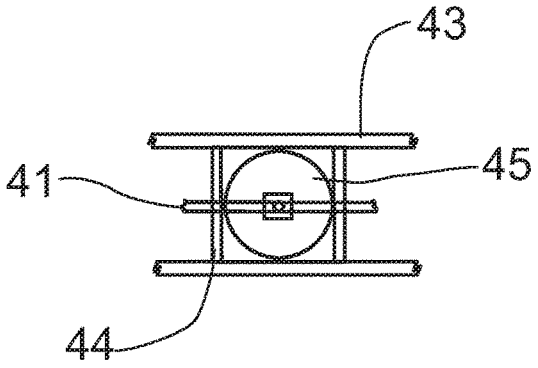
Fig. 8

DEDUSTING APPARATUS HAVING AIR KNIVES AND IONIZING WIRES

CROSS-REFERENCE TO RELATED APPLICATIONS

This application claims domestic priority from U.S. Provisional Patent Application Ser. No. 62/949,524, filed Dec. 18, 2019, the contents of which are incorporated herein by reference.

FIELD OF THE INVENTION

The invention disclosed in this application is directed generally to the cleaning and handling of particulate materials, such as plastic pellets, grains, glass, and the like, and more particularly to the removal of dust from the dedusting apparatus using ionizing wires to help separate dust particles from the particulate material.

BACKGROUND OF THE INVENTION

It is well known, particularly in the field of transporting and using particulate materials, commonly powders, granules, pellets, and the like that it is important to keep product particles as free as possible of contaminants. Particulates are usually transported within a facility where they are to be mixed, packaged, or used in a pressurized tubular system that in reality produces a stream of material that behaves somewhat like a fluid. As these materials move through the pipes, considerable friction is generated not only among the particles themselves, but also between the tube walls and the particles in the stream. This friction can cause an electrostatic charge on the dust particles and pellets passing through the dedusting apparatus attracting the dust particles to the pellet surface. In addition, this friction can result in the development of particle dust, broken particles, fluff, and streamers (ribbon-like elements that can "grow" into quite long and tangled wads that will impede the flow of materials or even totally block the flow). The characteristics of such a transport system are quite well known, as is the importance and value of keeping product particles as free as possible of contaminants.

The term "contaminant" as used herein includes a broad range of foreign material as well as the broken particles, dust, fluff, and streamers mentioned in the preceding paragraph. In any case, contaminants are detrimental to the production of a high quality product, and in some situations a health risk to employees of the producer and possibly even a source of danger in that some contaminants can produce a dust cloud which, if exposed to an ignition source, may explode.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and are, therefore, unsellable. It is important to note that since these same non-uniform materials often do not melt at the same temperature as the primary product, the unmelted contaminants cause friction and premature wear to the molding machines, resulting in downtime, lost production, reduced productivity, increased maintenance and thus increased overall production costs.

Conventional dedusting apparatus has a wash deck mounted within a housing with the wash deck being inclined to urge the flow of particulate material from the top of the wash deck to the bottom. The product inlet is above the top of the wash deck to direct the flow of particulate product onto the top of the wash deck after passing through an electro-magnetic ring that places a charge on the particulate product to separate the contaminants from the product. The wash deck is provided with slots and holes for the passage of air from beneath the wash deck and through the product flowing over the surface of the wash deck. The air moving through the slots is angled downstream to urge the flowing product to move faster, while the air passing through the holes in the wash deck bubble up through the particulate material to separate the contaminants from the particulates. Particulate material discharging off the lower end of the wash deck passes through a Venturi Zone where an additional flow of air removes the final contaminants before the particulate material falls through a discharge opening in the apparatus housing.

Accordingly, it would be desirable to provide a dedusting apparatus that provides an enhanced capability to remove dust and debris particles from a flow of particulate material.

SUMMARY OF THE INVENTION

It is an object of this invention to overcome the disadvantages of the prior art by providing a dedusting apparatus for particulate material that ionizes the dust particles in the flow of the particulate material to facilitate the removal thereof from the flow of particulate material.

It is another object of this invention that the dedusting apparatus is formed with a plurality of ionizing wires over which the flow of particulate material passes.

It is a feature of this invention that the wash deck of the dedusting apparatus is formed with vertical steps at intervals along the length of the wash deck.

It is an advantage of this invention that the vertical steps in the wash deck allow the flow of particulate material to drop vertically onto a lower section of wash deck.

It is another feature of this invention that the steps in the wash deck provide a location for placement of an air knife and an ionizing wire.

It is another advantage of this invention that the ionizing wire establishes an ionizing charge on the dust and debris particles falling over the step and past the ionizing wire.

It is still another feature of this invention that the step in the deck provides for the placement of air slots to blow air across the ionizing wire to ionize the particles in the flow of particulate material.

It is still another advantage of this invention that the flow of air across each of the ionizing wires and through the corresponding air slots in the vertical step creates an air knife passing through the flow of particulate material dropping over the wash deck step.

It is yet another feature of this invention that the ionizing wires receive electrical current from a supply wire positioned at the sides of the wash deck.

It is yet another advantage of this invention that the air flow through the wash desks pass through openings in the surfaces of the wash decks to remove ionized dust and debris particles from the flow of particulate material.

It is a feature of this invention that the wash deck can be formed with an overhang at each vertical step so that the ionizing wire can be positioned underneath the overhang.

It is another feature of this invention that the ionizing wire can be positioned behind the vertical step, with respect to the flow of air through the air knife slots.

It is another advantage of this invention that the positioning of the ionizing wire proximate to the air knife slots permits the introduction of ions into the flow of particulate material falling along the vertical step in the wash deck.

It is another object of this invention to provide a wash deck configuration that can be constructed as modules.

It is still another feature of this invention that each wash deck module can be formed with a planar cleaning surface and an integral step member that is oriented generally perpendicularly to the cleaning surface.

It is yet another feature of this invention that each wash deck module incorporates a pair of mounting tabs on opposing ends thereof for engagement with corresponding slots formed in the opposing side walls.

It is yet another advantage of this invention that each wash deck module is supported from the opposing side walls through the insertion of the mounting tabs into the corresponding side wall slots.

It is still another advantage of this invention that mounting tabs along each side of the wash deck module are oriented generally orthogonally to one another.

It is a further feature of this invention that the cleaning surface portion of each wash deck module can be mounted on the step member of the adjacent and lower wash deck module such that the cleaning surface portion overhangs the vertical step to the wash deck module immediately below.

It is yet another object of this invention to provide a wash deck configuration that can be constructed as a unitary folded device.

It is a feature of this invention that the wash deck can be formed from a flat pattern blank into which air holes for the cleaning surface and air slots for establishing an air knife can be punched into the flat pattern blank.

It is another feature of this invention that the flat pattern with the air holes and air slots formed therein can then be bent along bend lines to form the steps oriented generally perpendicularly to the cleaning surfaces.

It is an advantage of this invention that the folded, or bent, wash deck configuration can also be formed with mounting tabs that can be received in corresponding slots in the opposing side walls for support thereof.

It is another advantage of this invention that ionizing wires can be mounted behind the air knife slots, with respect to the flow of air therethrough, to create a flow of ions with the air knife engaging the flow of particulate material dropping from one cleaning surface level to the next lower cleaning surface level.

It is a further advantage of this invention that the use of an air knife passing through the flow of particulate material falling over a vertical step in the wash deck urges the particulate material along the wash deck toward a discharge edge of the wash deck.

It is still a further advantage of this invention that the wash deck can be oriented at a smaller angle to horizontal than previously known in dedusting devices.

It is yet a further advantage of this invention that a dedusting apparatus incorporating a wash deck having an air knife at each vertical step in the wash deck can be manufactured with less cost.

It is still another advantage of this invention that the dedusting apparatus having an air knife blowing ions from an ionizing wire into the flow of particulate material passing over the wash deck does not require an electromagnetic device at the infeed structure.

These and other objects features and advantages are accomplished according to the instant invention by providing a dedusting apparatus for the removal of dust and debris from the flow of particulate material over the surface of wash decks formed with steps and an air knife that engages the flow of particulate material as the material drops from one wash deck level to another. An ionizing wire is placed at each step on the wash deck so that the air knife blows negative ions from the ionizing wire into the particulate material falling off the step onto the level of wash deck below the ionizing wire. The wash deck is formed with openings to allow air to blow through the wash deck surface and remove dust and debris from the flow of particulate material. The wash deck can be constructed from modules supported on one another in a manner to present an overhang at each step. The wash deck can alternatively be formed as an integral bent structure from a flat pattern.

BRIEF DESCRIPTION OF THE DRAWINGS

The advantages of this invention will become apparent upon consideration of the following detailed disclosure of the invention, especially when taken in conjunction with the accompanying drawings wherein:

FIG. 6 is a top perspective view of a wash deck showing the individual wash deck modules and side walls in phantom with the ionizing wire system being schematically shown in solid lines;

FIG. 7 is an enlarged top view of the connection between the ionizing wire and the electrical supply wires interconnecting the ionizing wires corresponding to circle 7 in FIG. 6;

FIG. 8 is a further enlarged elevational view of the connection between one of the ionizing wires and the electrical supply wires;

DETAILED DESCRIPTION OF THE PREFERRED EMBODIMENT

Figure 1:
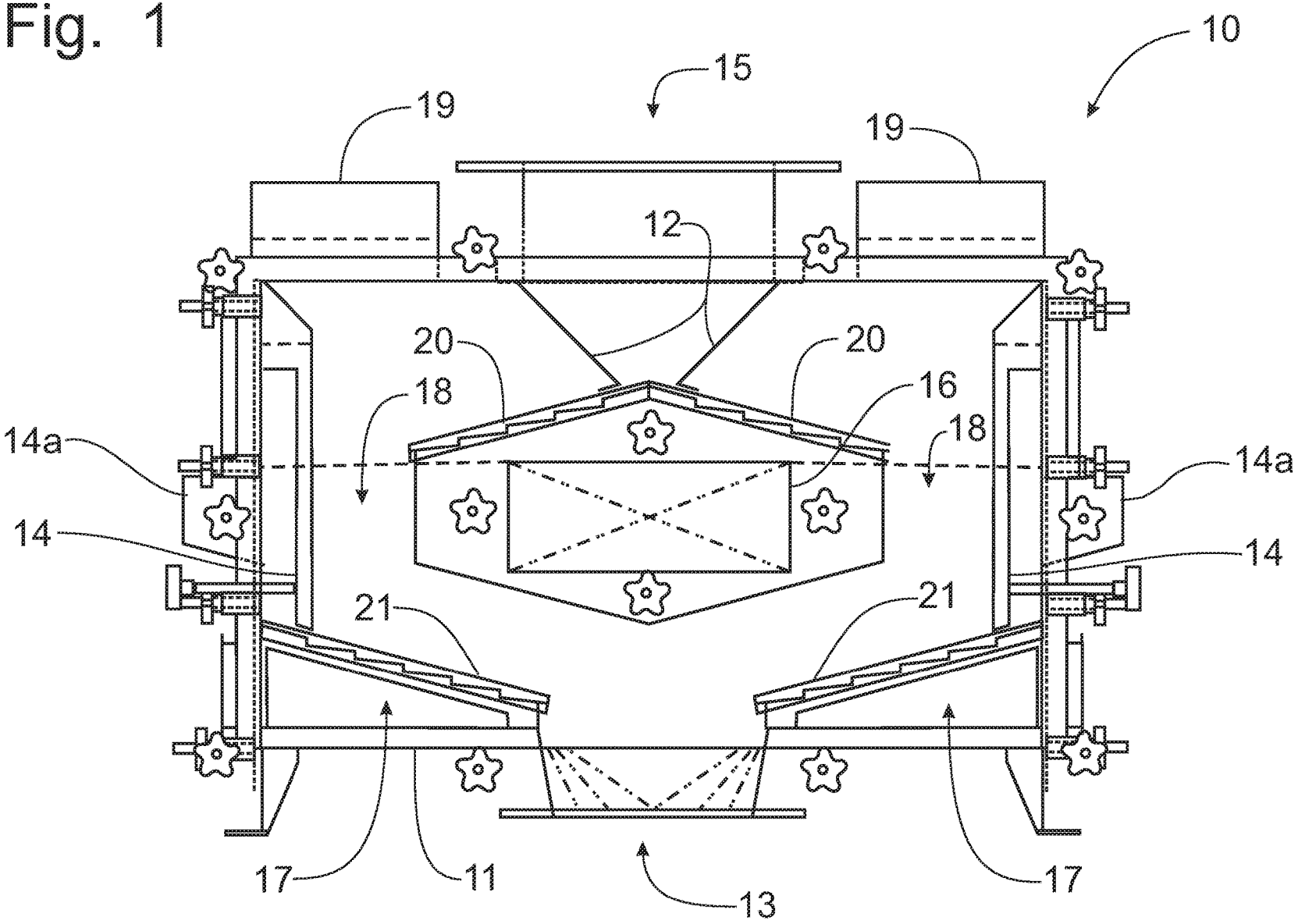
FIG. 1 is a front elevational view of a compact dedusting apparatus incorporating the principles of the instant invention.

Referring to FIG. 1, a dedusting apparatus 10 is typically associated with a silo unloading of material into bags, trucks, rail cars or any other container (not shown). For purposes of explanation, particulate product (in this example, plastic pellets plus the usual contaminants associated therewith) is fed into the dedusting apparatus 10 at the product inlet 15 where the particulate material falls onto the upper portion of a wash deck 20. Preferably, the upper portion of the dedusting apparatus 10 includes inlet deflectors 12, which direct the flow of material across the top of the wash deck 20 and into a laminar flow as is known in the art. One skilled in the art will recognize that the inlet deflectors 12 can be manually positioned relative to the wash deck 20 or via automated controllers (not shown).

While FIG. 1 depicts a configuration of a dedusting apparatus 10 that has opposing upper wash decks 20 and opposing lower wash decks 21 that receive particulate material discharged from the respective upper wash decks 20 to be directed to a central product discharge outlet 13, other configurations of dedusting apparatus 10 would be equally receptive to using the instant invention, including dual outlet dedusting apparatus, single offset outlet dedusting apparatus, single wash deck with a discharge outlet aligned with the product inlet opening 15, and others. Such alternative configurations can be found in U.S. Pat. No. 8,931,641, granted on Jan. 13, 2015, to Heinz Schneider; in U.S. Pat. No. 8,833,563, granted on Sep. 16, 2014, to Heinz Schneider and Paul Wagner; and in U.S. Pat. No. 7,621,975, granted on Nov. 24, 2009, to Heinz Schneider and Paul Wagner.

Referring now to FIGS. 2-8, the details of the instant invention can best be seen. The wash deck 20 is formed by a plurality of wash deck modules 25 that are mounted between opposing side walls 22. The respective width of the wash deck 20 can vary from one dedusting apparatus 10 configuration to another, and therefore, FIGS. 4-6 reflect a central portion of the wash deck 20 being broken away for purposes of clarity. Each wash deck module 25, except for the uppermost wash deck module 29, is formed with a generally planar cleaning portion 26 and a support flange 27 bent upwardly at approximately 80-100 degrees relative to the cleaning portion 26 to support the adjacent cleaning portion 26 of the wash deck module 25 thereabove.

Each wash deck module 25 terminates in opposing side edges engaged with the side walls 22 with each cleaning portion 26 having a tab 28 projecting from the side edge of the cleaning portion 26, and each support flange 27 also have a tab 28 projecting outwardly therefrom, so that the tabs 28 on each side of the wash deck 25 can be inserted into openings 23 formed in the side walls 22 to receive the tabs 28. Accordingly, each wash deck module 25 is supported from the opposing side walls 22 from the tabs 28 extending through the openings 23 in the side walls 22. The openings 23 are positioned such that the cleaning portion 26 of each wash deck module 25 rests on top of the support flange 27 of the module immediately below. In addition, the front edge of each wash deck module 25, 29, except for the lowermost wash deck module 25, overlaps the support flange 27 and establishes an overhang of the beginning of the cleaning portion 26 of the wash deck module 25 below.

The cleaning portion 26 of each wash deck module 25, 29 is formed with a plurality of holes 32 extending through the wash deck module 25 for the passage of air therethrough. The holes 32 can be arranged in one or more rows of holes transversely oriented across the cleaning portion 26, depending on the size of the wash deck modules 25 or the holes 32 could be dispersed in a different pattern, so long as the holes 32 provide a cleaning flow of air from beneath the wash deck 25 and through the flow of particulate material flowing over the top of the cleaning surface 26, as will be described in greater detail below.

Each support flange 27 is also formed with a plurality of openings 35 arranged in a row across the transverse width of the support flange 27 to form an air knife 30 flow of air through the support flange 27 and directed into the flow of particulate material falling off the overlapping discharge edge of the cleaning portion 26 of the wash deck module 25 thereabove. This air knife 30 serves to accelerate the flow of particulate material down the wash deck 20, and thus eliminates, or at least minimizes, the need for slots to be formed in the cleaning portion 26 of each wash deck module 25 as is known in prior art dedusting apparatus. In addition, the air knife 30 also serves to remove contaminants from the flow of particulate material falling off the overlapping edge of the cleaning surface 26 thereabove. Further, the air knife 30 also pushes ions from the ionizing wire 42, which will be described in greater detail below, into the flow of particulate material so that the ions will connect with the dust particles in the air and on the surface of the particulate material pellets.

With the air knife 30 accelerating particulate material across the adjacent cleaning surface 26, the slope of the wash deck 25 can be significantly shallower than is known in the existing dedusting apparatus. Conventional wash decks of known dedusting apparatus are typically oriented at approximately 30 degree from horizontal. With the induced acceleration from the air knives 30, the orientation of the wash decks 25 can be reduced to approximately 15 degrees, which enables the structure of the dedusting apparatus to have a smaller height than previously known in the art.

For dedusting apparatus configurations utilizing a lower wash deck 17, as depicted in FIG. 1, the lower wash decks 21 would also be formed from wash deck modules 25, stacked as described above. However, the wash deck modules 25 may not require the formation of any holes 32 through the cleaning portion 26 of each wash deck module 25, as the cleaning operation of the upper wash decks 25 could be sufficient to remove the unwanted contaminants from the flow of particulate material. Nevertheless, the support flanges 27 would be formed with openings 35 to form air knives 20 at the beginning of each wash deck module 25 to continue the acceleration of the flow of the cleaned particulate material along the lower wash decks 21 toward the discharge opening 13. This intense flow of air through the air knife openings 35 is also effective in removing contaminants, including streamers, from the particulate material product flow falling off of the overlapping cleaning portion 26 of the wash deck module 25 above the air knife 30.

Each ionizing wire 42 is part of an ionization system 40 forming an integral part of the instant invention to use high voltage electrical current to ionize (electrically charge) air molecules with negative ions that confer a negative charge to particles. As can be seen in the schematic depiction of the ionizing system 40 shown in FIG. 6, the ionizing wire 42 extends from a metal ball 45 allowing the ionizing wire 42 to be pulled taut across in front of each air knife 30. Each ionizing wire 42 receive electrical current from an electrical supply wire 41, which in turn receives electrical current from a power source 49 preferably supported on the rear side of the dedusting apparatus 10. Each metal ball 45 is supported in a non-conductive plastic housing 44 that is part of the plastic cover 43 extending over the supply wires 41, as is schematically shown in FIG. 6.

Figure 2:
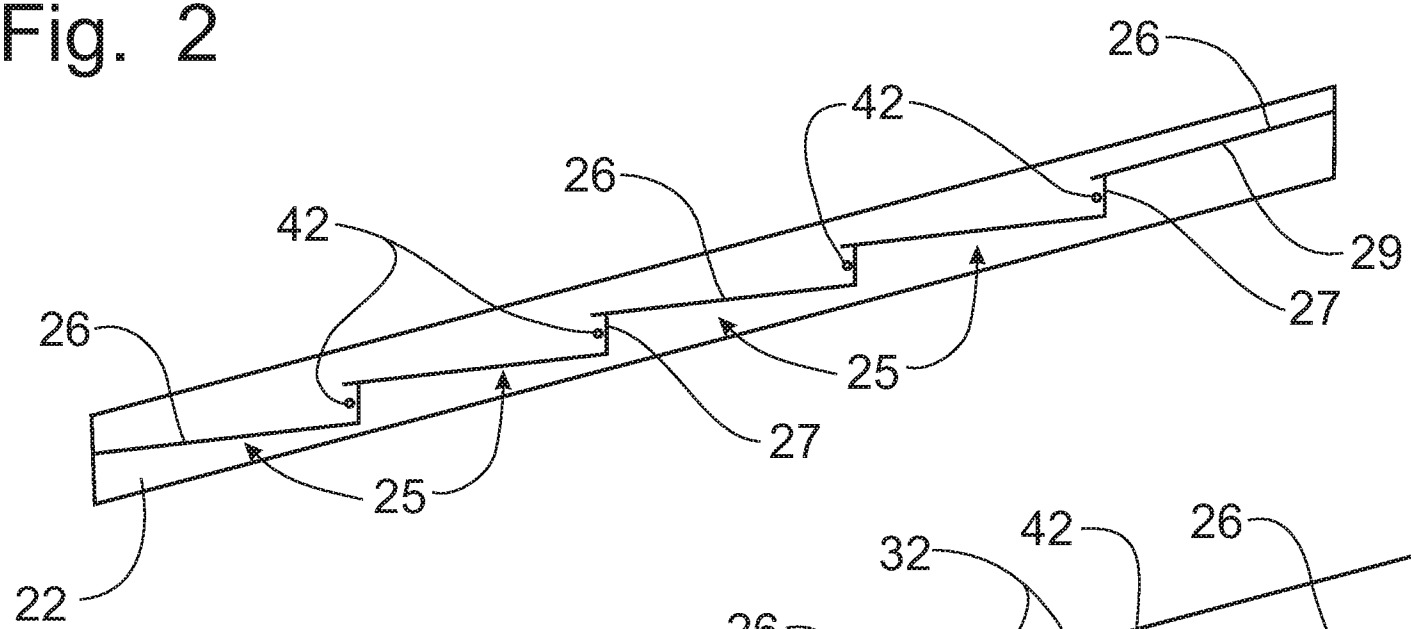
FIG. 2 is an enlarged side elevational view of a portion of the wash deck shown in FIG. 1 with the ionizing wires mounted beneath an overhang in front of air knife slots formed in the vertical step.
Figure 3:
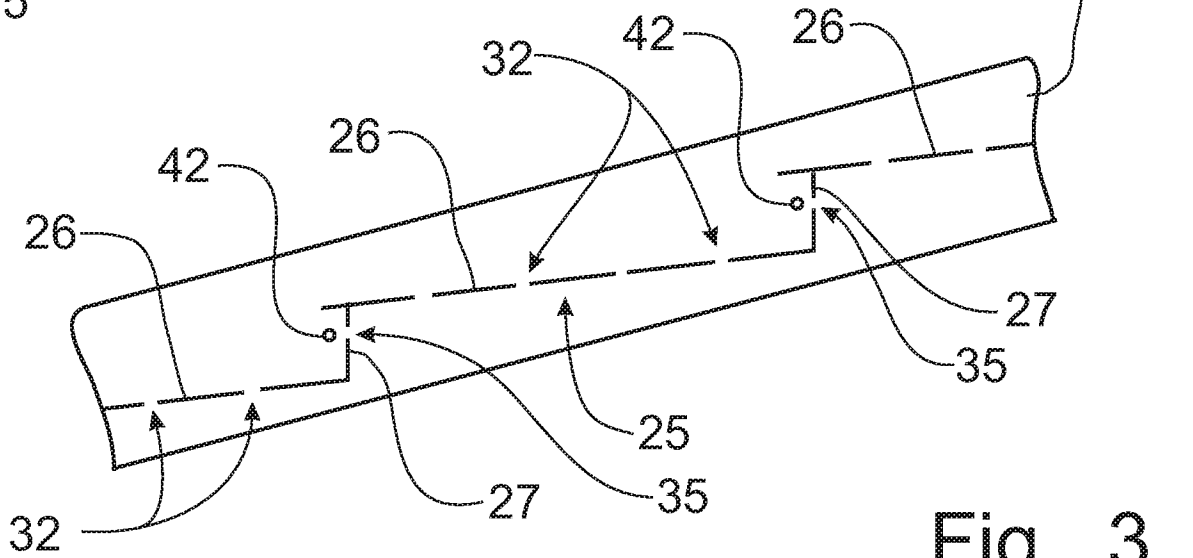
FIG. 3 is a further enlarged side elevational view of a portion of the wash deck showing the holes through the wash deck modules, the air knives, and the ionizing wires incorporating the principles of the instant application.
Figure 5:
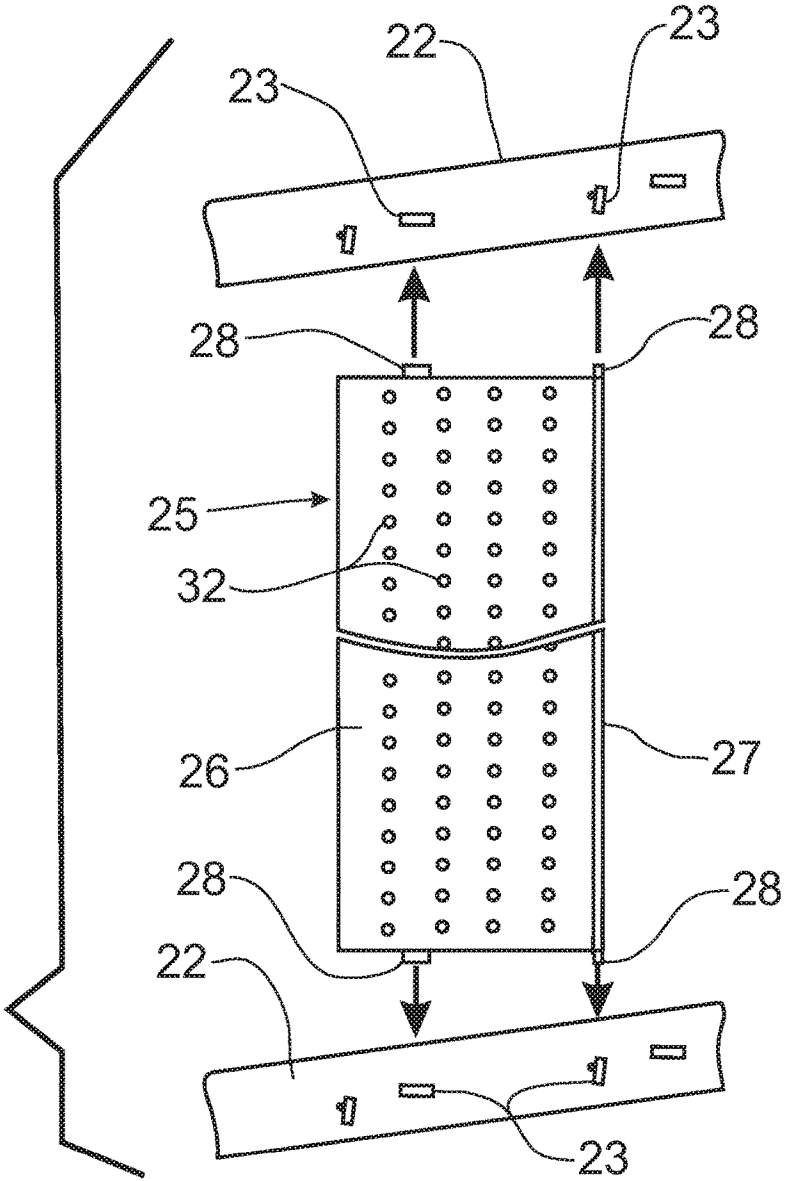
FIG. 5 is an exploded view of the connection between each wash deck module and the side walls supporting the wash deck module.
Figure 4:
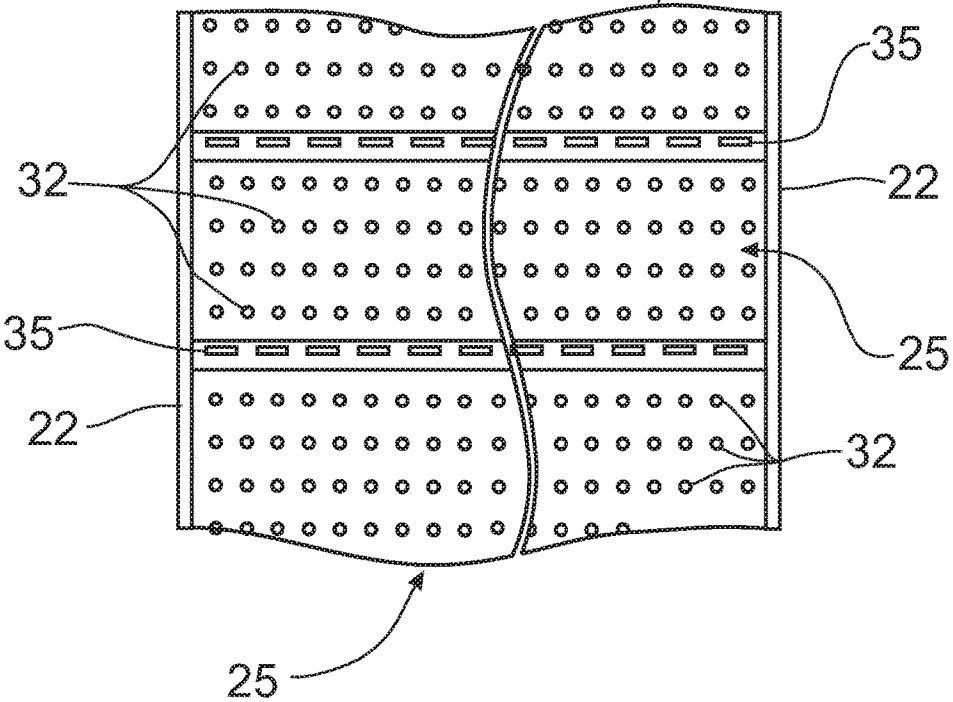
FIG. 4 is an upper perspective view of a portion of the wash deck to show the holes through the wash deck modules and the air knives.
Figure 9:
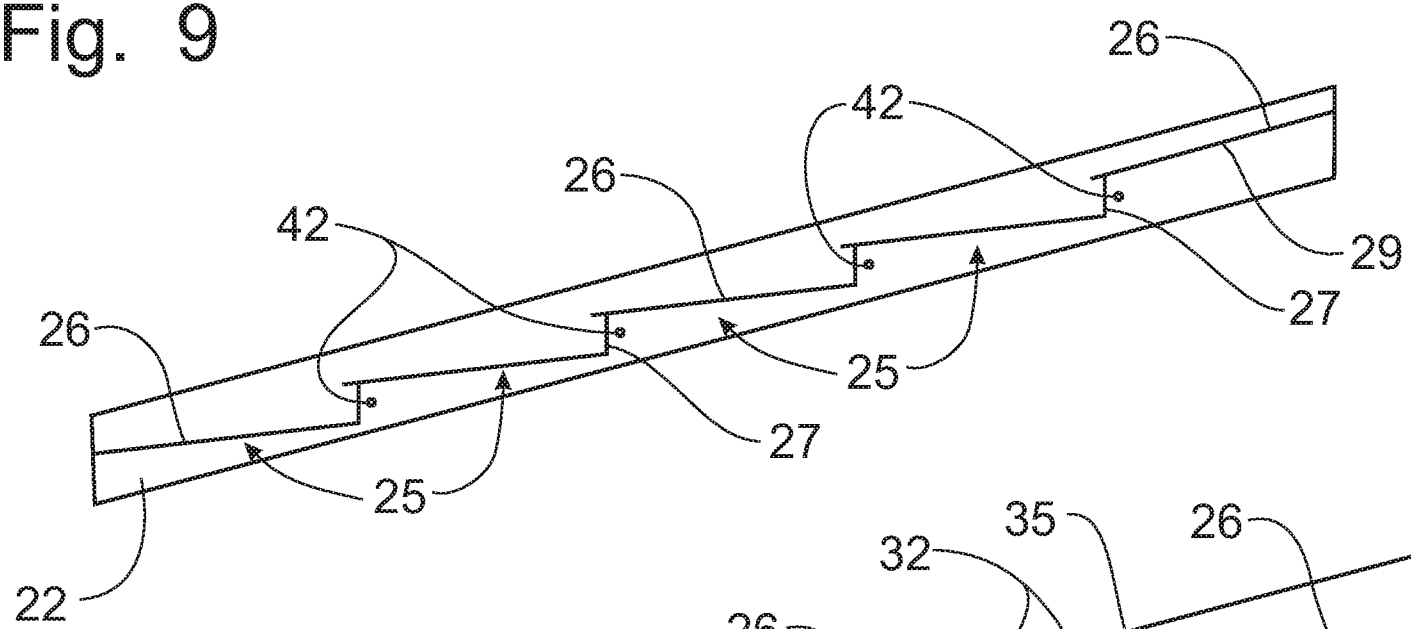
FIG. 9 is an enlarged side elevational view of a portion of the wash deck similar to that of FIG. 2, but with the ionizing wires mounted behind the vertical step so that ions are blown through the air knife slots in the vertical step.
Figure 10:
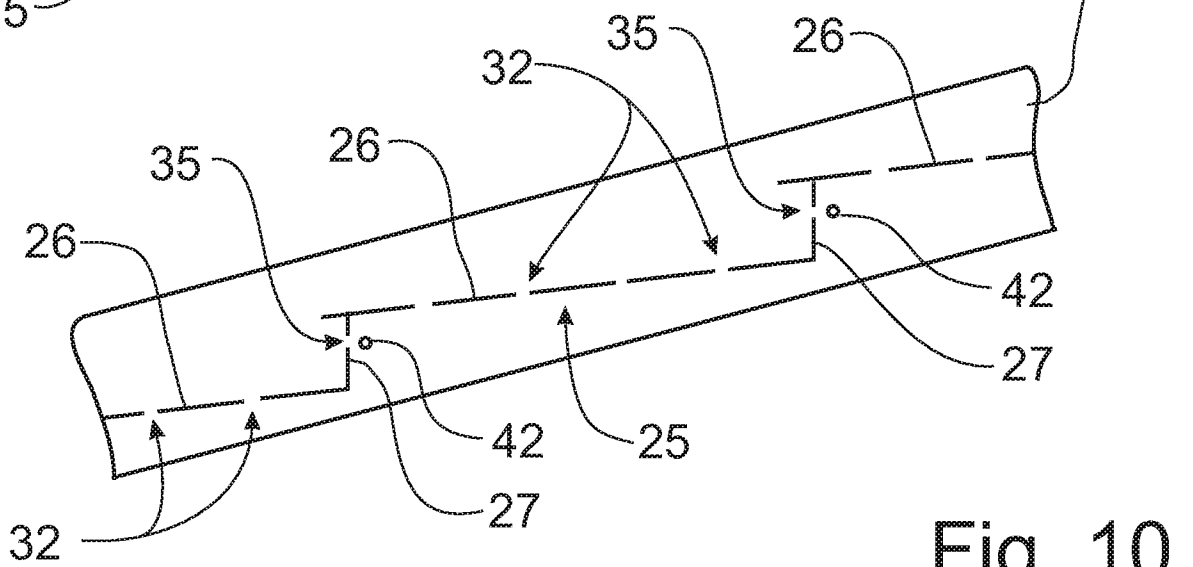
FIG. 10 is a further enlarged side elevational view of a portion of the wash deck corresponding to the embodiment depicted in FIG. 9, showing the ionizing wires positioned behind the air knife slots in vertical steps.
Figure 11:
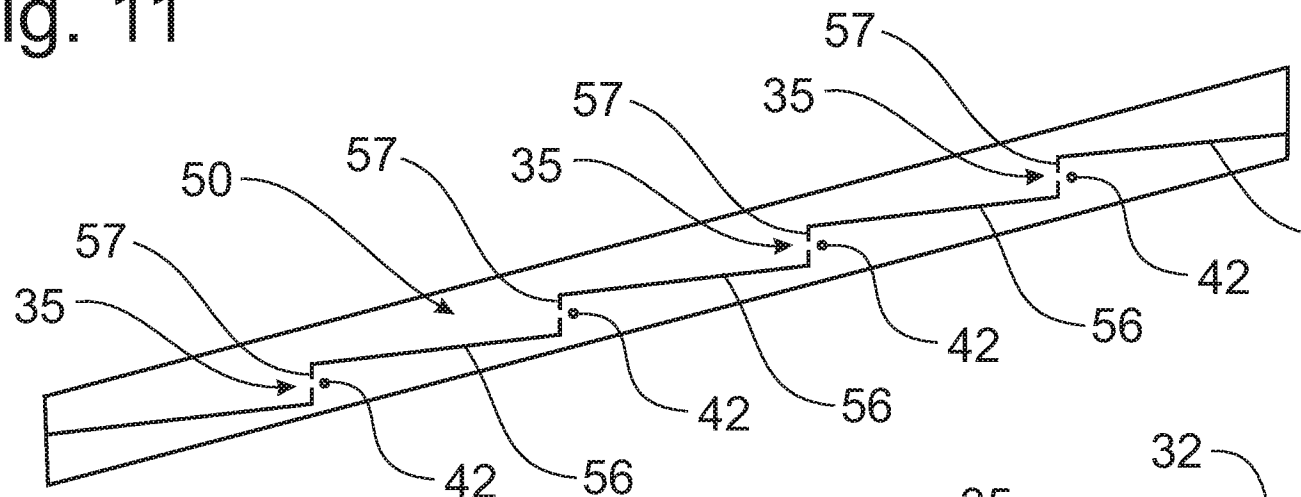
FIG. 11 is an enlarged side elevational view of a portion of the wash deck similar to that of FIG. 9, but formed as a unitary bent structure and having the ionizing wires mounted behind the vertical step.
Figure 12:
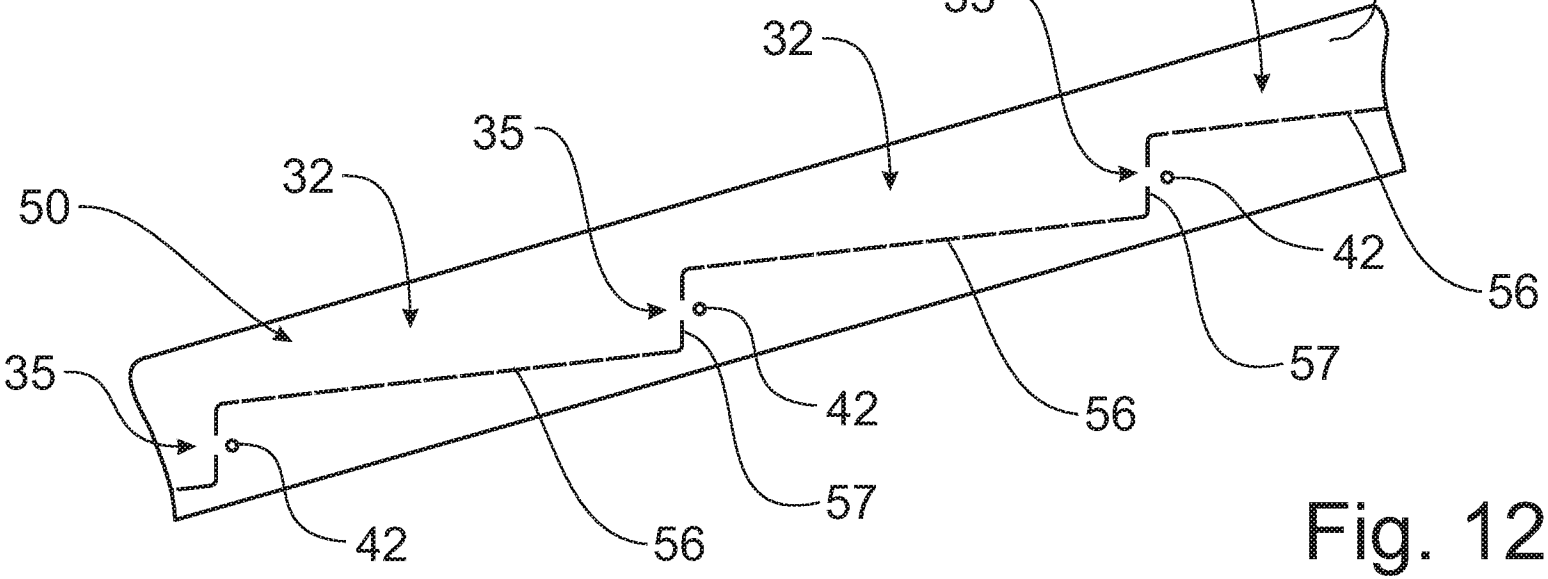
FIG. 12 is a further enlarged side elevational view of a portion of the wash deck corresponding to the embodiment depicted in FIG. 11, showing the ionizing wires positioned behind the air knife slots in vertical steps.

A preferred embodiment of the ionization system 40 would have the supply wires 41 running along the exterior of the side walls 22 in a non-conductive manner, such as being housed within the plastic cover 43, with a supply wire 41*a* extending beneath the top edge of the uppermost wash deck module 29 to deliver electric current to the opposing supply wire 41 on the exterior of the opposing side wall 22, completing an electrical circuit. Each ionizing wire 42 is positioned in alignment with the openings 35, preferably in front of the openings 35 as is depicted in FIGS. 2 and 3, but the ionizing wire 42 could also be placed behind the openings 35, as is depicted in FIGS. 9 and 10, so that the air knife 30 formed thereby blows ions from the ionizing wire 42 through the openings 35 and into the flow of particulate material.

Figures 13, 14:
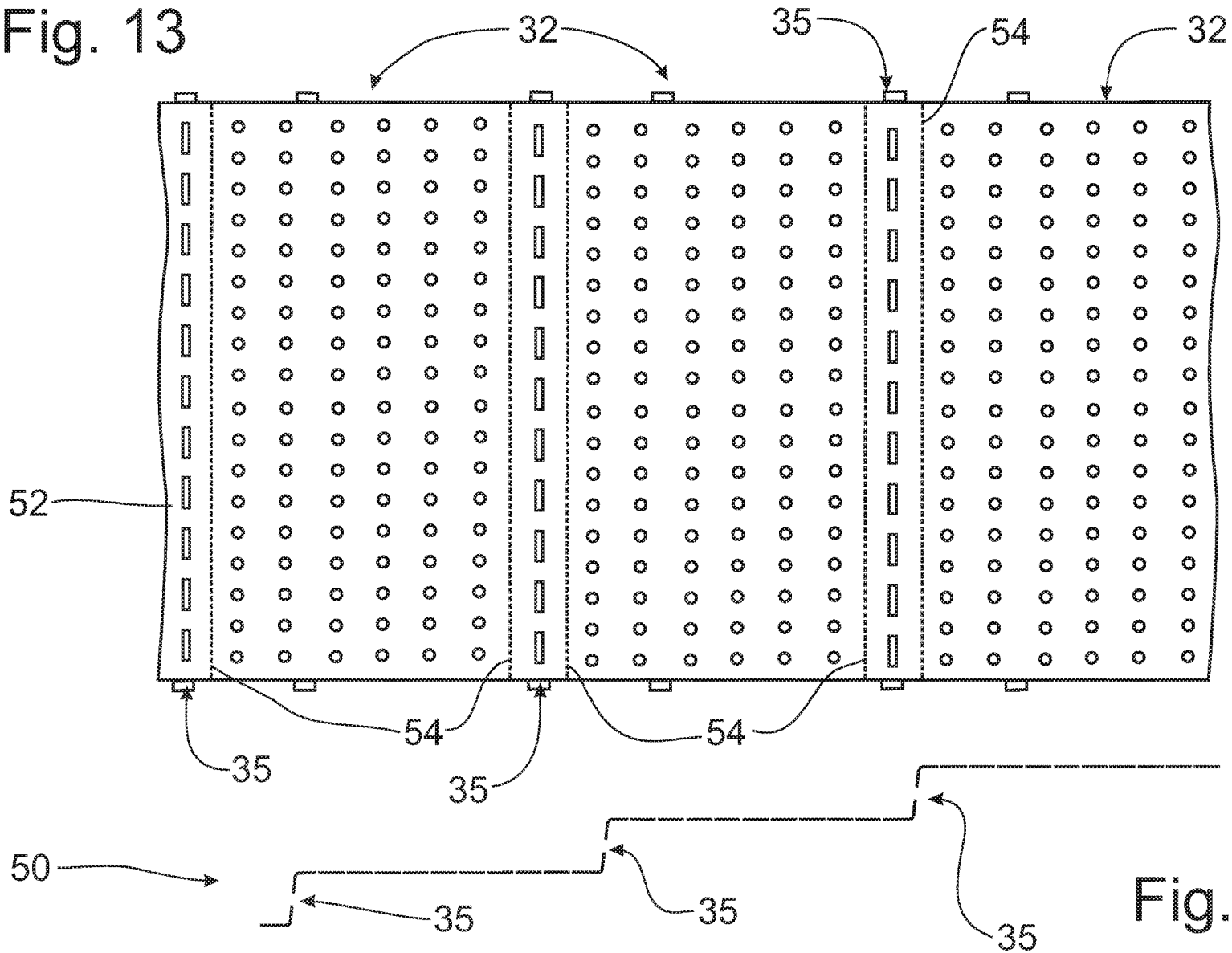
FIG. 13 is a schematic representation of a portion of a flat pattern for creating the integral bent wash deck depicted in FIG. 11, bend lines being depicted as dotted lines.
FIG. 14 is a schematic elevational view of a portion of the integral, bent wash deck after the flat pattern has been through a manufacturing process to bend the flat pattern along the bend lines.

Referring now to FIGS. 11-14, one skilled in the art will recognize that the stepped wash deck configuration can be affected by constructing the wash deck 50 as a unitary bent apparatus, rather than constructing the wash deck 20, 50 from modules 25. As is schematically represented in FIGS. 13 and 14, the formed wash deck 50 would start with a flat blank of metal, such as stainless steel, into which the openings 32 and 35 are punched while the flat pattern 52 remains planar. Then the flat pattern 52 can be bent using conventional manufacturing methods along the bend lines 54 to create the formed wash deck 50, as shown in FIG. 14, which orients the air knife openings 35 in the vertical steps and the cleaning openings 32 in the orthogonal planar cleaning portions. Since the formed wash deck 50 is created from a flat pattern 54, the overhang of the cleaning portion 56 over the vertical step 57 and the upper part of the next cleaning portion 56 is eliminated. As a result, the ionizing wire 42 would need to be placed behind the air knife openings 35, with respect to the flow of air therethrough, so that the was deck 50 would protect the ionizing wires 42.

In operation, the dedusting apparatus 10 receives a supply of air under pressure into the housing 11 in a conventional manner, and delivers the air through a central opening 16 located in the back wall of the housing 11 underneath the wash decks 20, and simultaneously through supplemental openings 17 beneath the lower wash decks 21. Air entering through the central opening 16 passes through the holes 32 and openings 35 in the upper wash deck modules 25 to remove contaminants from the flow of particulate material and to distribute ions to the particulate material and to accelerate the particulate material, as is described in greater detail above. The air exiting the upper wash decks 25 ultimately exits the housing 11 through the raised air outlets 19 at the top of the housing 11 on opposing sides of the product inlet 15.

The air entering the housing 11 through the supplemental openings 17 beneath the lower wash decks 21 pass through the air knives 30, and any cleaning holes 32 therein, formed in the respective lower wash deck modules 25 and move through Venturi zones 18 to remove any remaining difficult contaminants from the flow of particulate material dropping off the lowermost wash deck module 25. The air flow through the Venturi zones 18, along with the air flow through the upper wash decks 20 and the contaminants removed from the particulate material discharge through the raised air outlets 19, described above. The air discharged from the housing 11 can be cleaned and recycled and returned to the housing 11, as described above.

One of ordinary skill in the art will recognize that the housing 11 preferably carries a positionally adjustable vertical baffle 14 along each Venturi zone 18 to regulate the air passing through the Venturi zones 18. Bypass boxes 14*a* are also provided along the sides of the housing 11 behind the vertical baffles 14 to supplement the flow of air through the Venturi zones 18, as needed. This air flow from the bypass boxes 14*a* flows beneath the vertical baffles 14 and then upwardly through the Venturi zones 18 for a thorough cleaning of the particulate material dropping off the upper wash decks 20 toward the lower wash decks 21. The positioning of the vertical baffles 14 and the adjustment of the amount of air flowing through the bypass boxes 14*a* provides a large range of control over the operation of the Venturi zones 18. Ultimately, the cleaned particulate material is discharged from the housing 11 through the product discharge port 13, which, depending on the configuration of the housing 11, can be located at the central part of the housing 11 or offset to one or more sides of the housing 11.

Referring to FIGS. 1-8, the air flowing through the central opening 16 exits through the upper wash decks 20 through the holes 32 in the cleaning portions 26 of the wash deck modules 25 to lift and flow through the particulate material top remove contaminants from the particulate material, and also through the air knife openings 35 formed in the support flanges 27 so that the air flow moves past the ionizing wires 42 to transfer ions to the particulate material and the contaminants therein, and to flow through the particulate material dropping off the overlapping edge of one wash deck module 25 onto the next wash deck module 25. In addition, the air moving through the air knife openings 35 also pushes the particulate material downstream and accelerates the flow of the particulate material.

As a result, the upper wash decks 20 do not require the formation of slots in the cleaning portions 26, as is known in the art, to urge movement of the particulate material downstream. Furthermore, the transfer of ions from the ionizing wire 42 eliminates the need to provide an electromagnetic field to the infeed of particulate material onto the wash decks 20. Also, with the acceleration of the particulate material provided by the air knives 30, the slope of the wash decks 20, 21 can be reduced to about half of the slope of known wash decks of dedusting apparatus, allowing the height of the dedusting apparatus 10 to be reduced significantly without affecting operational efficiencies.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

For example, while the drawings, specifically FIG. 1, depict a dedusting apparatus 10 having opposing primary and secondary wash decks 20, 21, the principles of the instant invention can be applied to any dedusting apparatus configuration, such as a dedusting apparatus having only a single primary wash deck 20, or a single primary and secondary wash deck 20, 21. Furthermore, the principles of the instant invention can also be applied to the formation of a wash deck for a cylindrical dedusting apparatus, as is disclosed in U.S. Pat. No. 8,800,777, or a half round dedusting apparatus, such as is disclosed in U.S. Pat. No. 10,646,902, by forming a series of steps around the circular circumference of the wash deck and then placing an ionizing wire inside or outside of air knife openings formed in the steps similar to that disclosed above.

Having thus described the invention, what is claimed is:

1. A dedusting apparatus for cleaning dirt and debris from particulate material, comprising:

a housing;

a product infeed located at an upper portion of said housing for the introduction of particulate material to be cleaned into said housing;

a primary wash deck supported in said housing below said product infeed to receive a flow of said particulate material from said product infeed onto said wash deck, said wash deck being formed from a plurality of wash deck modules defining a cleaning portion and a support flange, each said cleaning portion having a plurality of holes therethrough and each said support flange including a plurality of air knife openings;

an air inlet opening in said housing to introduce a first air flow beneath said primary wash deck to provide an air flow through said holes in each said cleaning portion and through said air knife openings to accelerate particulate material flow along said primary wash deck; and an ionizing wire positioned along each said support flange in alignment with said air knife openings to provide a source of negative ions to be transferred to said particulate material dropping from one wash deck module to another in front of said support flange.

2. The dedusting apparatus of claim 1 wherein said primary wash deck is formed with an uppermost wash deck module that includes only a cleaning portion supported on the support flange of the next wash deck module.

3. The dedusting apparatus of claim 1 wherein said primary wash deck includes opposing side walls formed with mounting slots therein, each said cleaning portion and each said support flange being formed with a tab on opposing ends thereof for receipt within a corresponding mounting slot in said side walls.

4. The dedusting apparatus of claim 1 wherein said each said support flange supports a cleaning portion of the wash deck module thereabove in an overlapping manner such that the ionizing wire is positioned beneath the supported overlapping cleaning portion and in front of the corresponding support flange.

5. The dedusting apparatus of claim 1 wherein said primary wash deck is oriented at a slope of approximately 15 degrees.

6. The dedusting apparatus of claim 1 wherein said housing further supports a secondary wash deck positioned below said primary wash deck to receive particulate material discharged off of said primary wash deck and direct said particulate material toward a product discharge opening.

7. The dedusting apparatus of claim 6 wherein each said secondary wash deck is formed with secondary wash deck modules having only said air knife openings formed therein to accelerate the flow of particulate material toward said product discharge opening.

8. The dedusting apparatus of claim 7 wherein said housing includes a supplemental air opening below said secondary wash deck to provide a flow of air through said air knife openings in said secondary wash deck modules.

9. The dedusting apparatus of claim 1 wherein said primary wash deck is formed of two wash decks mounted with the uppermost wash deck modules connected at an apex below said product infeed, said primary wash decks being directed downwardly from said apex in opposing directions, said secondary wash deck including a secondary wash deck below each of said primary wash decks to receive respectively particulate material therefrom.

10. The dedusting apparatus of claim 1 wherein said ionizing wire is located behind the air knife openings, with respect to the flow of air through the air knife openings, so that the air flow through the air knife openings carries the negative ions into the flow of particulate material falling in front of said support flanges.

11. In a dedusting apparatus for cleaning particulate material, said dedusting apparatus having a housing; a product infeed located at an upper portion of said housing for the introduction of particulate material to be cleaned into said housing; a wash deck supported in said housing below said product infeed to receive a flow of said particulate material from said product infeed onto said wash deck; and an air inlet opening in said housing to introduce a flow of air beneath said wash deck, the improvement comprising:

said wash deck being formed as a unitary formed device bent from a flat pattern into a shape having a plurality of generally vertical steps separated by planar cleaning surfaces with said plurality of cleaning surfaces being located between respective vertical steps, each said cleaning surface having a plurality of cleaning holes formed therein for the passage of air therethrough to pass through said particulate material flowing over said cleaning surfaces, each said vertical step including air knife openings for the passage of air therethrough creating an air knife to engage particulate material falling from an upper cleaning surface to a lower cleaning surface, and an ionizing wire positioned behind each vertical step with respect to the direction of air flow through said air knife openings in alignment with said air knife openings such that the flow of air through said air knife openings carries negative ions through said air knife openings into said particulate material falling in front of the corresponding said vertical step.

12. The dedusting apparatus of claim 11 wherein said wash deck is formed from a plurality of wash deck modules with each module including one of said planar cleaning surfaces and one of said vertical steps extending generally orthogonally to the corresponding said cleaning surface.

13. The dedusting apparatus of claim 12 wherein the cleaning surface of said cleaning surface of an upper wash deck module rests on said vertical step of a lower wash deck module for support thereof.

14. The dedusting apparatus of claim 13 each said wash deck module includes a first mounting tab along opposing edges of said planar cleaning surfaces and a second mounting tab along opposing edges of said vertical step, each said wash deck module being engaged with opposing side walls having mounting openings therein to receive said first and second mounting tabs for support of each said wash deck module.

15. The dedusting apparatus of claim 13 further comprising:

an ionizing wire supported along each said vertical step in alignment with said air knife openings so that said air flow through said air knife openings carries negative ions into said particulate material falling from upper wash deck module to said lower wash deck module.

16. The dedusting apparatus of claim 15 wherein each upper cleaning surface resting on the corresponding lower vertical step overlaps the lower vertical step and a portion of the lower cleaning surface to provide an overhang member, said ionizing wire being positioned beneath said overhang structure in alignment with said air knife openings through said lower vertical step.

17. The dedusting apparatus of claim 15 wherein said ionizing wire is positioned behind the corresponding air knife openings with respect to the direction of air flow through said air knife openings such that the flow of air through said air knife openings carries negative ions through said air knife openings into said particulate material falling in front of the corresponding said vertical step.

18. A dedusting apparatus for cleaning dirt and debris from particulate material, comprising:

a housing;

a product infeed located at an upper portion of said housing for the introduction of particulate material to be cleaned into said housing;

a wash deck supported in said housing below said product infeed to receive a flow of said particulate material from said product infeed onto said wash deck, said wash deck being formed as a unitary formed device bent from a flat pattern into a shape having a plurality of generally vertical steps and a plurality of cleaning surfaces between successive vertical steps, each said cleaning portion having a plurality of cleaning holes therethrough and each said vertical step including a plurality of air knife openings;

an air inlet opening in said housing to introduce a first air flow beneath said primary wash deck to provide an air flow through said cleaning holes in each said cleaning portion and through said air knife openings to accelerate particulate material flow along said wash deck; and an ionizing wire positioned behind each vertical step with respect to the direction of air flow through said air knife openings, said ionizing wire being in alignment with said air knife openings such that the flow of air through said air knife openings carries negative ions through said air knife openings into said particulate material falling in front of the corresponding said vertical step.

* * * * *